US007682158B2

(12) United States Patent
Tsai

(10) Patent No.: US 7,682,158 B2
(45) Date of Patent: Mar. 23, 2010

(54) ELECTRICAL CARD CONNECTOR FOR DIFFERENT SIZE CARDS

(76) Inventor: Chou Hsien Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 12/190,733

(22) Filed: Aug. 13, 2008

(65) Prior Publication Data

US 2009/0047813 A1 Feb. 19, 2009

(51) Int. Cl.
*H01R 12/00* (2006.01)

(52) U.S. Cl. ..... 439/61; 439/631; 439/638

(58) Field of Classification Search ..... 439/217, 439/630–631, 61, 62, 64, 638–639, 945–946; 361/737, 784
See application file for complete search history.

(56) References Cited

U.S. PATENT DOCUMENTS 5,679,007 A * 10/1997 Potdevin et al. ..... 439/76.1
6,612,492 B1 * 9/2003 Yen ..... 235/451
6,738,259 B2 * 5/2004 Le et al. ..... 361/737
2006/0105634 A1 * 5/2006 Wu et al. ..... 439/630
2008/0280462 A1 * 11/2008 Ho et al. ..... 439/64

* cited by examiner

*Primary Examiner*—Edwin A. Leon
*Assistant Examiner*—Vanessa Girardi
(74) *Attorney, Agent, or Firm*—Pro-Techtor Int'l Services; Ralph Willgohs

(57) ABSTRACT

An electrical card connector includes: a plastic base having one row of first terminals and a first slot; and an upper cover, which has a top surface and covers over the plastic base. A partition baffle is disposed below the top surface of the upper cover. Each side of the partition baffle is formed with a side portion. A first inserting port is formed below the partition baffle. A second inserting port is defined and enclosed by the partition baffle, the two side portions and the top surface of the upper cover. When a first card is inserted into the first slot from the first inserting port, connection points of the first card are in direct contact with the first terminals. When a second card is slantingly inserted from the second inserting port, connection points of the second card are lowered and thus in direct contact with the first terminals.

12 Claims, 10 Drawing Sheets

ELECTRICAL CARD CONNECTOR FOR DIFFERENT SIZE CARDS

BACKGROUND OF THE INVENTION

1. Field of Invention

The invention relates to an electrical connector, and more particularly to an electrical connector to be connected to an electrical card.

2. Related Art

Electrical cards for computers include multimedia storage cards or memory cards. The available memory cards, such as the Secure Digital Card (SDC), MultiMedia Card (MMC), Smart Media Card (SMC), Memory Stick Card (MSC), Compact Flash Card (CFC), and the like, in the market have various specifications. Because the positions of connections points of the memory cards with different specification are not the same, electrical connectors to be connected to the memory cards with different specifications are not the same.

In order to facilitate the usage, the manufacturers try to integrate different electrical connectors into an electrical connector assembly suitable for various memory cards with various specifications.

As shown in FIG. 1, the MSCs have two specifications of size, and will be referred to as a big card and a small card. First ends of the big card 10 and the small card 15 are respectively formed with connection point 11 and 16 arranged in the same manner. The big card 10 is thicker and wider than the small card 15. Thus, it is very difficult to make the same terminals be electrically connected to the big card and the small card inserted into the multi-card connector, and to make the big card and the small card be firmly engaged. This is because a slot of the connector for engaging with the small card may stop the inserted big card or other cards. So, the conventional connector only has the slot for engaging with the big card, and the small card is engaged with elastic sheers disposed on two sides and a top side. The elastic sheets press against the small card elastically. However, such a design cannot make the small card be firmly positioned and has the complicated structure.

SUMMARY OF THE INVENTION

It is therefore an object of the invention to provide an electrical card connector, which may be firmly electrically connected to connection points formed on two electrical cards having different sizes.

The invention achieves the above-identified object by providing an electrical card connector to be connected to first and second electrical cards. The electrical card connector includes: a plastic base having one row of first terminals and a first slot; and an upper cover, which has a top surface and covers over the plastic base. A partition baffle is disposed below the top surface of the upper cover. Each side of the partition baffle is formed with a side portion. A first inserting port is formed below the partition baffle. A second inserting port is defined and enclosed by the partition baffle, the two sides portions and the top surface of the upper cover. When the first electrical card is inserted into the first slot from the first inserting port, connection points of the first electrical card are in direct contact with the first terminals. When the second electrical card is slantingly inserted from the second inserting port, connection points of the second electrical card are lowered and thus in direct contact with the first terminals.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention

DETAILD DESCRIPTION OF THE INVENTION

The present invention will be apparent from the following detailed description, which proceeds with reference to the accompanying drawing, wherein the same references relate to the same elements.

Figure 1:
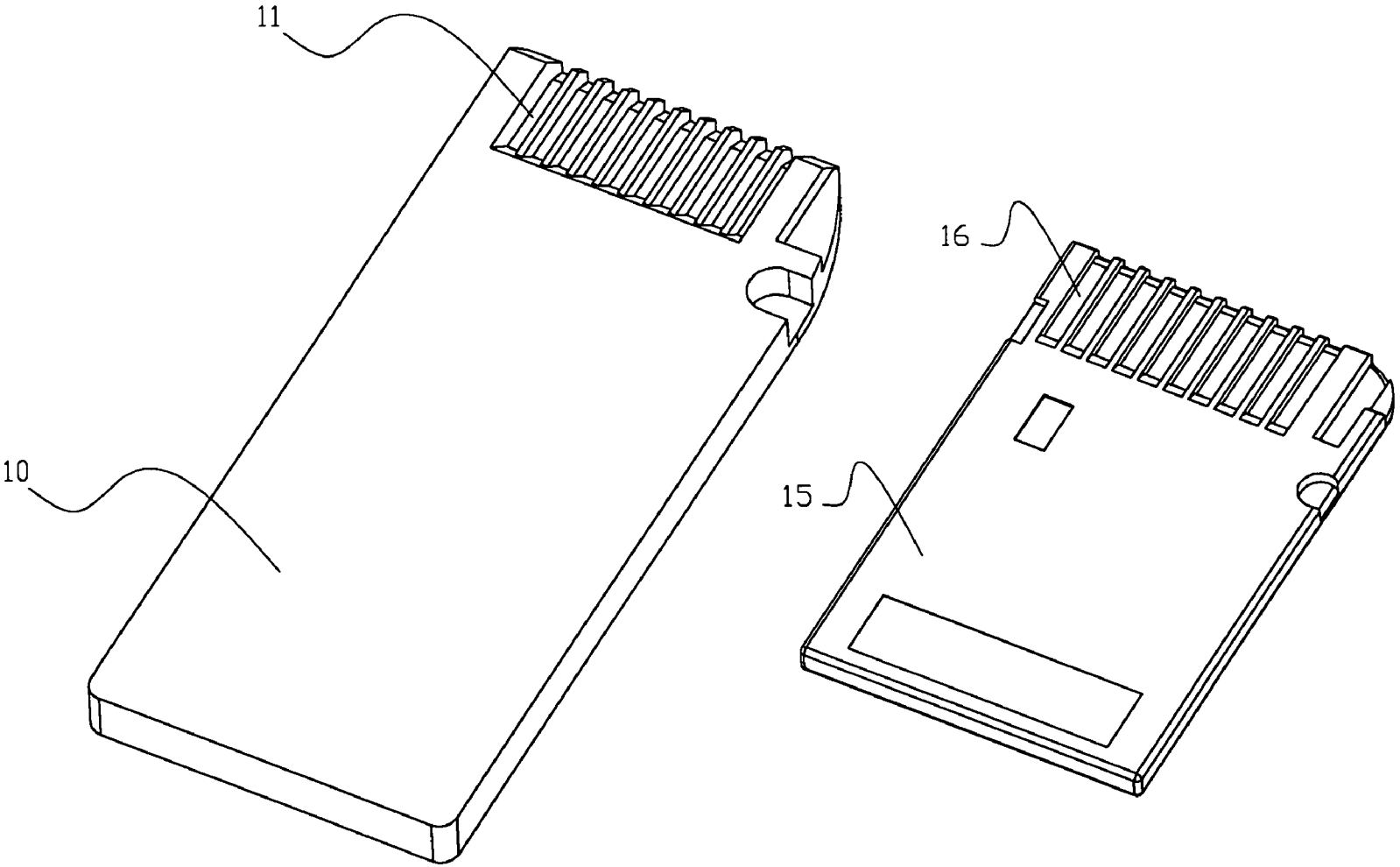
FIG. 1 (Prior Art)
FIG. 1 is a pictorial view showing two memory card.
Figure 2:
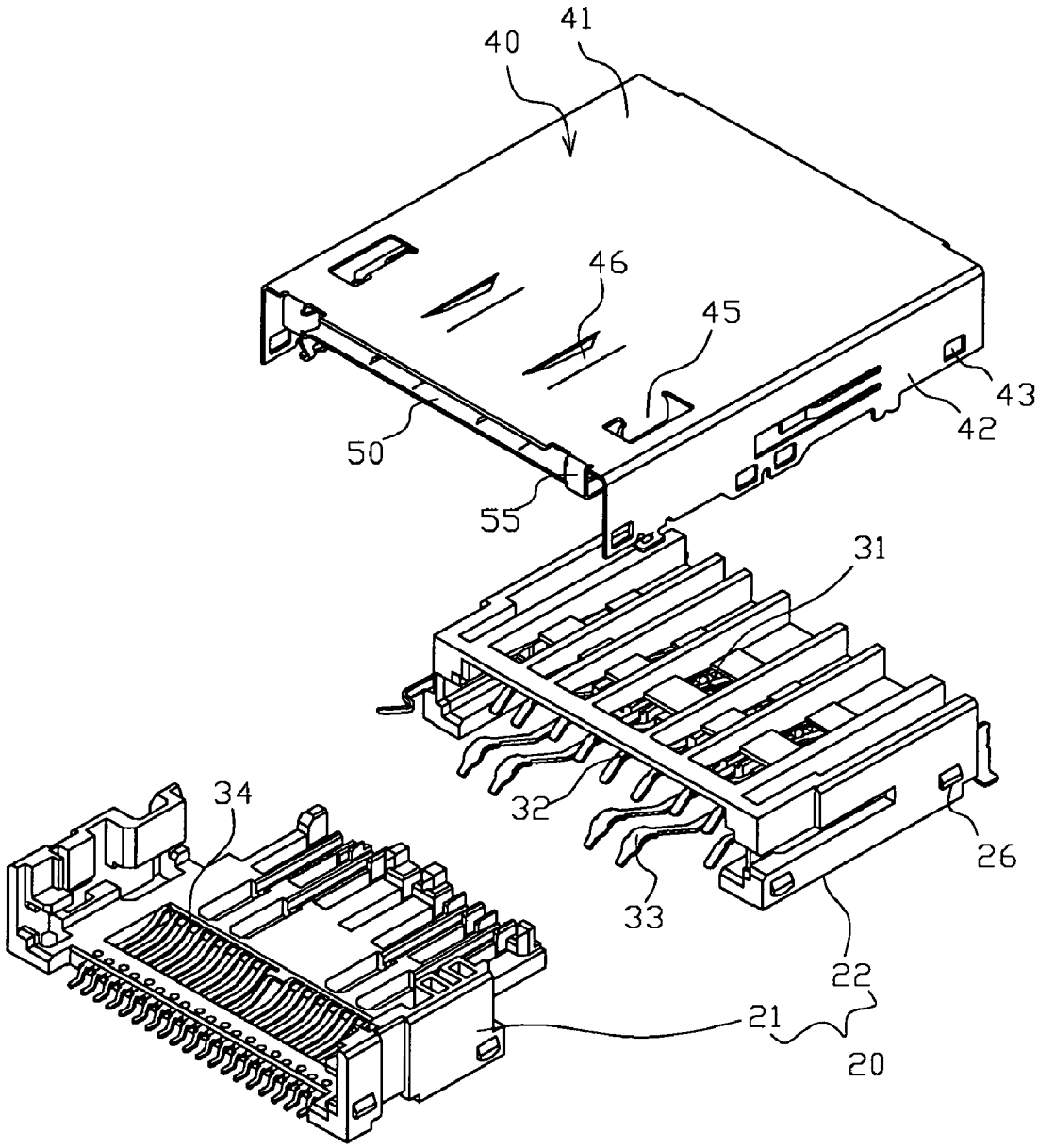
FIG. 2 is a pictorially exploded view showing an electrical card connector according to a first embodiment of the invention.
Figure 3:
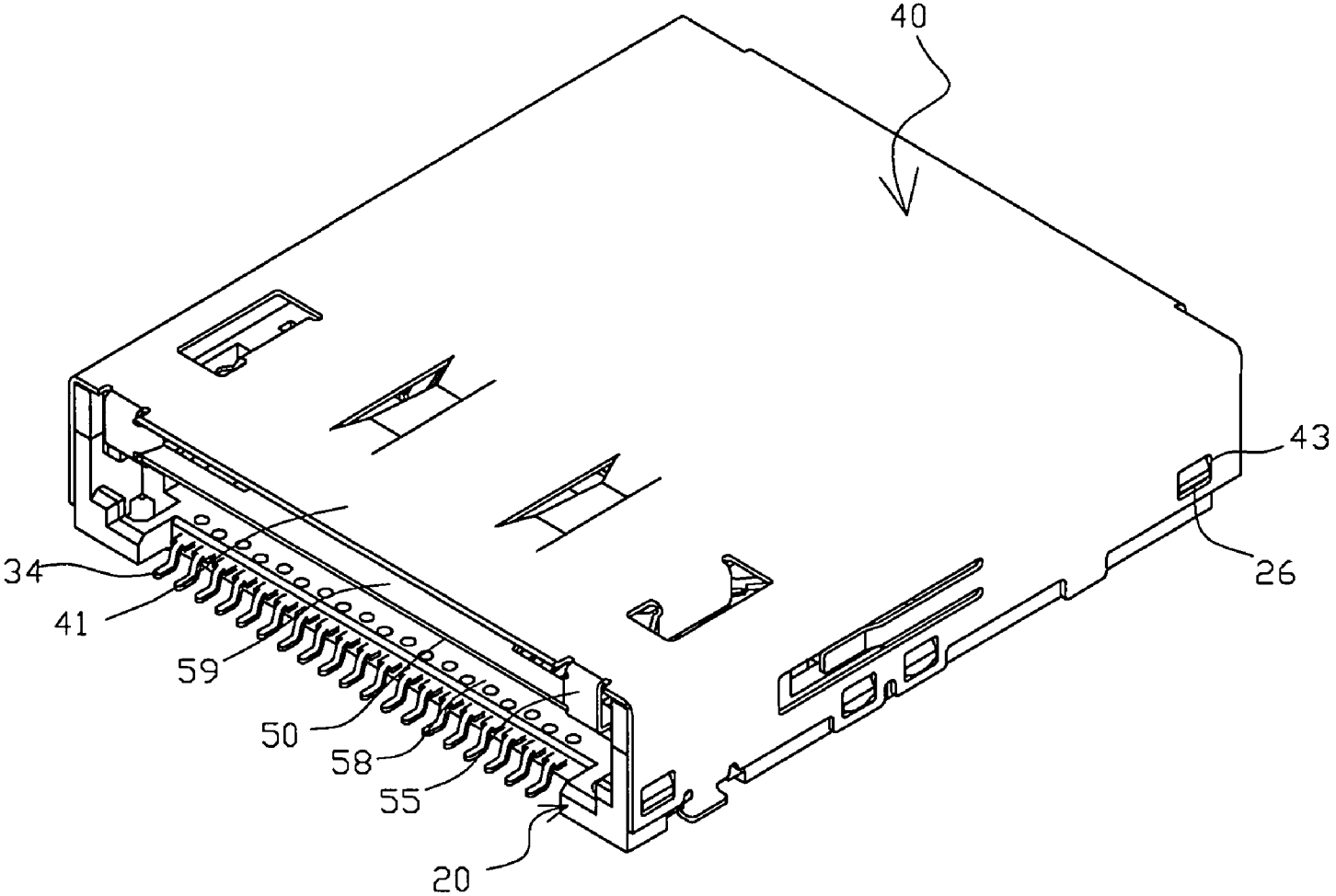
FIG. 3 is pictorially assembled view showing the electrical card connector according to the first embodiment of the invention.
Figure 4:
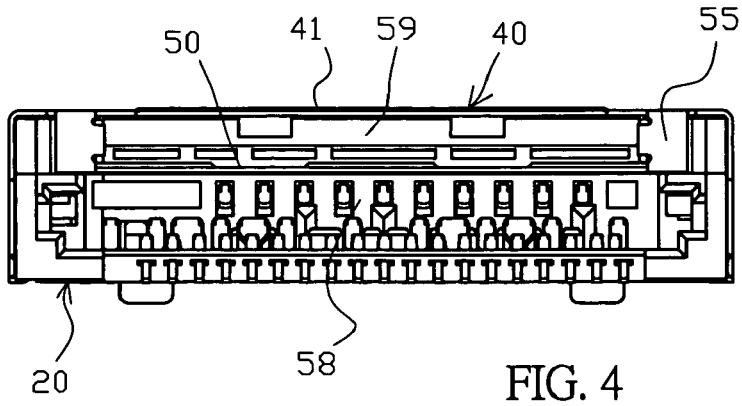
FIG. 4 is a front view showing the electrical card connector according to the first embodiment of the invention.
Figure 5:
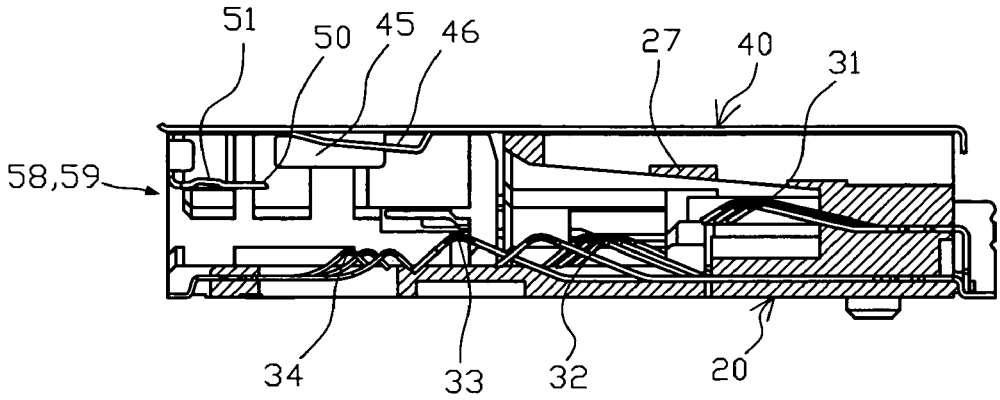
FIG. 5 is a side view showing the electrical card connector according to the first embodiment of the invention.

As shown in FIGS. 2 to 5, the electrical card connector of the invention is mainly to be connected to a first electrical card and a second electrical card, which is thinner and narrower than the first electrical card. First ends of the first and second electrical cards are formed with connection points arranged in same manner. The first electrical card is the big card 10 shown in FIG. 1, and the second electrical card is the small card 15 shown if FIG. 1. The connection points 11 of the big card 10 and the connection points 16 of the small card 15 are arranged in the same manner. The electrical card connector of the invention includes a plastic base 20, an upper cover 40, a partition baffle 50 and two side portions 55.

Figure 7:
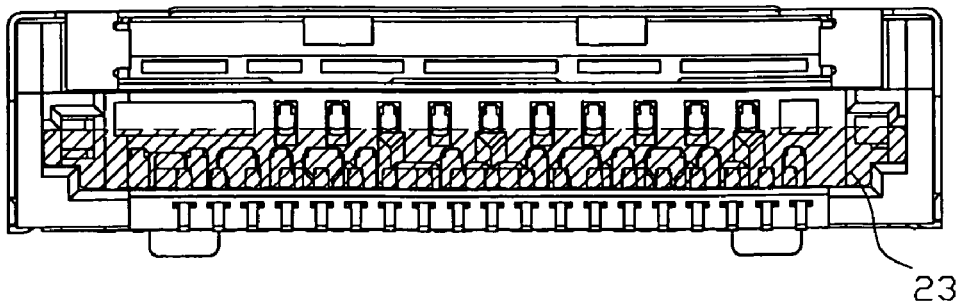
FIG. 7 is a schematic front view showing a first slot according to the first embodiment of the invention.
Figure 8:
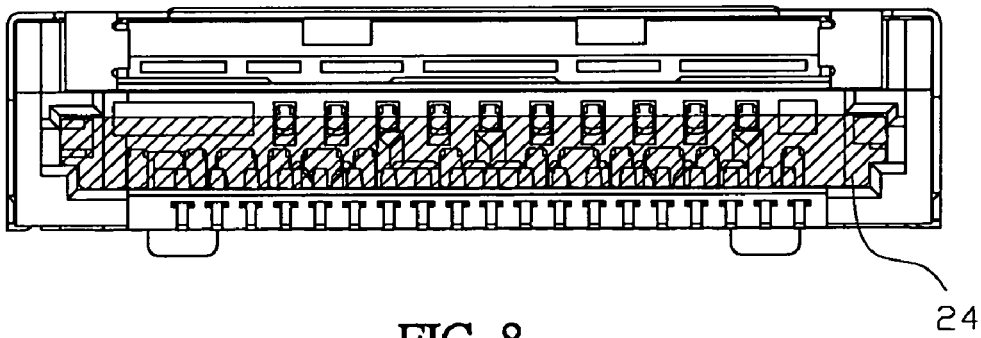
FIG. 8 is a schematic front view showing a second slot according to the first embodiment of the invention.
Figure 9:
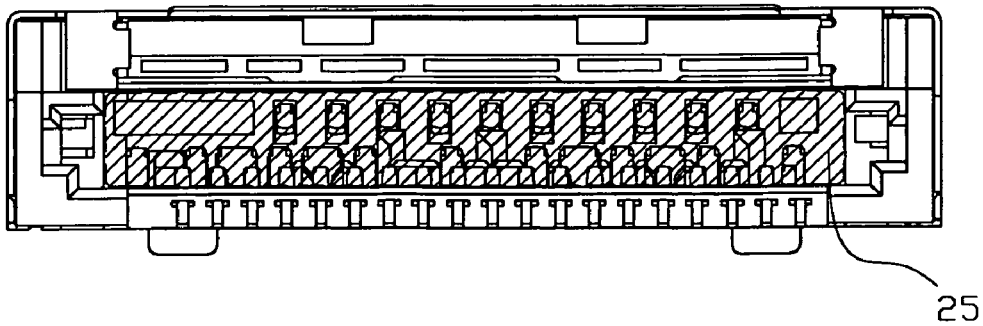
FIG. 9 is a schematic front view showing a third slot according to the first embodiment of the invention.

The plastic base 20 is composed of a front seat 21 and a rear seat 22, and is formed with a third slot 23 (see the hatched portion of FIG. 7), a second slot 24 (see the hatched portion of FIG. 8) and a first slot 25 (see the hatched portion of FIG. 9). The three slots have different widths of heights and share a common space so that the electrical cards with different sizes may be inserted and positioned therein. The SMC may be inserted into the third slot 23 and positioned therein. The SDC may be inserted into the second slot 24 and positioned therein. The front seat 21 has one row of second terminals 32 and one row of third terminals 33. Two engaging blocks 26 are respectively disposed on two sides of each of the front seat 21 and the rear seat 22. In addition, the rear seat 22 has a first sloped surface 27.

Figure 6:
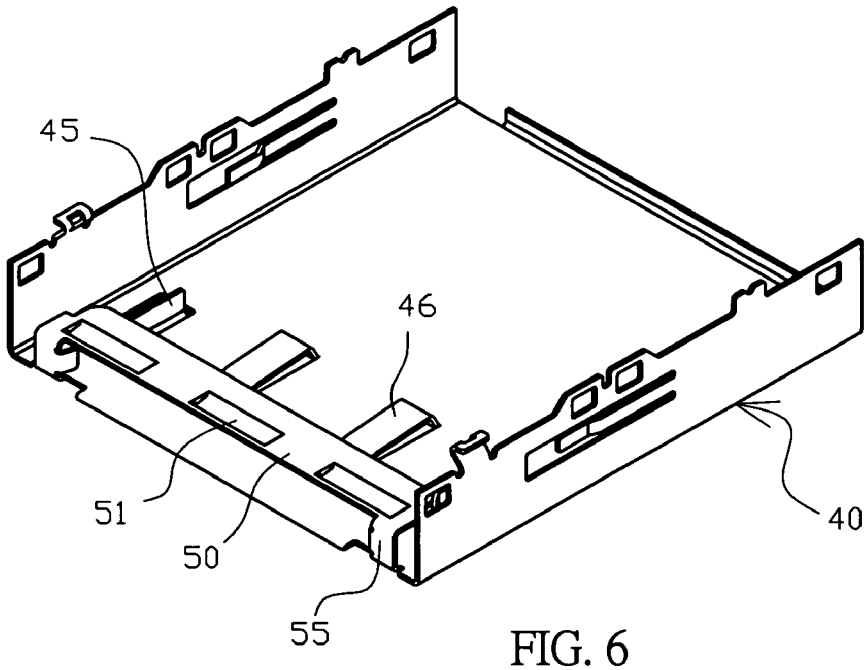
FIG. 6 is a pictorial view showing an inner surface of an upper cover according to the first embodiment of the invention.

As shown in FIG. 6, the upper cover 40 is formed by pressing a metal plate material and has an inverse-U shape. The upper cover 40 has a top surface 41 and two side surfaces 42. Each of the side surfaces 42 has four engagement holes 43 are engaged with the engaging blocks 26 of the plastic base 20. Two side sheets 45 are formed by pressing the top surface 41 inwards at locations near two sides of the front section of the surface. A projecting second sloped surface 46 is also formed by pressing the top surface 41 inwards at the middle location. The second sloped surface 46 and the first sloped surface 37 have the same slope.

The partition baffle 50, the two side portions 55 and the upper cover 40 are integrally formed by way of pressing. The partition baffle 50 and the two side portions 55 are bent inversely downwards at the front end of the top surface of the upper cover 40. The partition baffle 50 is in a transversally horizontal state and has a third sloped surface 51 projecting upwards. The third sloped surface 51 and the second sloped surface 46 have the same slope. Each of the two sides of the partition baffle 50 is formed with the longitudinal side portion 55. The two side portions 55 are connected to the front end of the top surface of the upper cover 40. A first inserting port 58 is formed below the partition baffle 50. A second inserting port 59 is formed above the partition baffle 50. The second inserting port 59 is defined and enclosed by the partition baffle 50, the side portions 55 and the top surface 41 of the upper cover 40. The gap between the two side portions 55 is equal to the width of the second inserting port 59. The width of the second inserting port 59 corresponds to the width of the small card 15, and is narrow than the first slot 25, the second slot 24 and the third slot 23. In addition, the gap between the side sheets 45 of the inner surface of the upper cover is equal to the width of the second inserting port 59.

Figure 10:
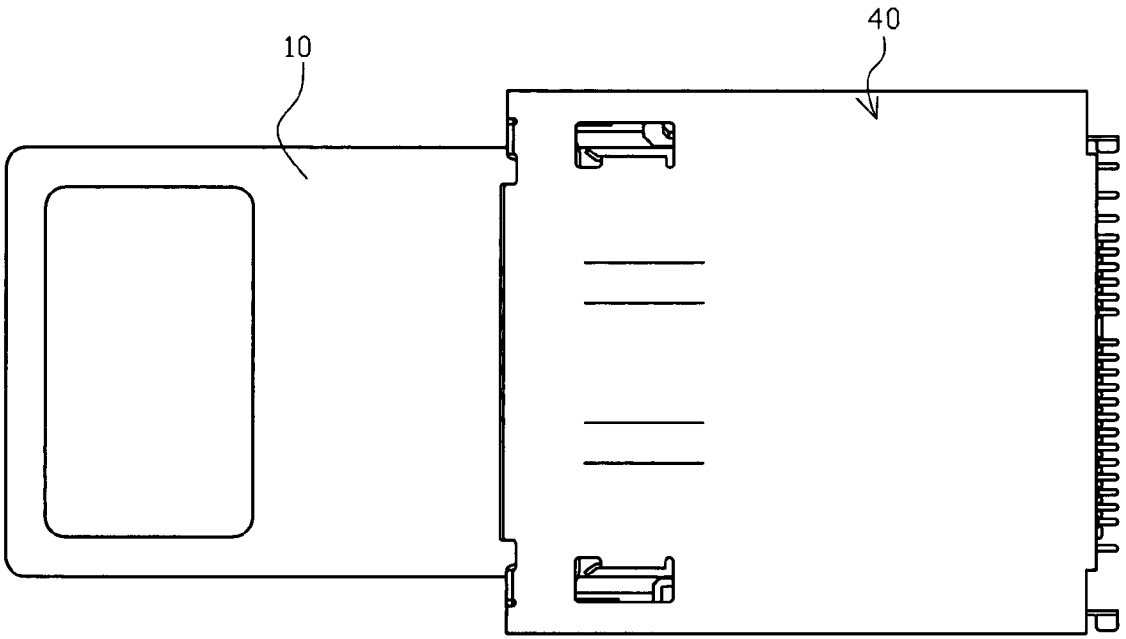
FIG. 10 is a top view showing a state when a big card is inserted according to the first embodiment of the invention.
Figure 11:
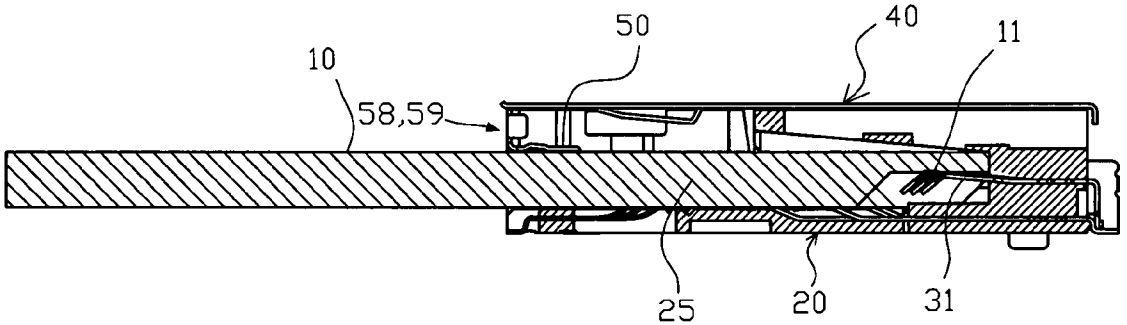
FIG. 11 is a laterally cross-sectional view showing the state when the big card is inserted according to the first embodiment to the invention.

As shown in FIGS. 10 and 11, when the big card 10 is inserted and positioned into the first slot 25 from the first inserting port 58 below the partition baffle 50, the top of the big card 10 may rest against the partition baffle 50 for positioning, and the connection points 11 at its front end can be in direct contact with the first terminals 31.

Figure 12:
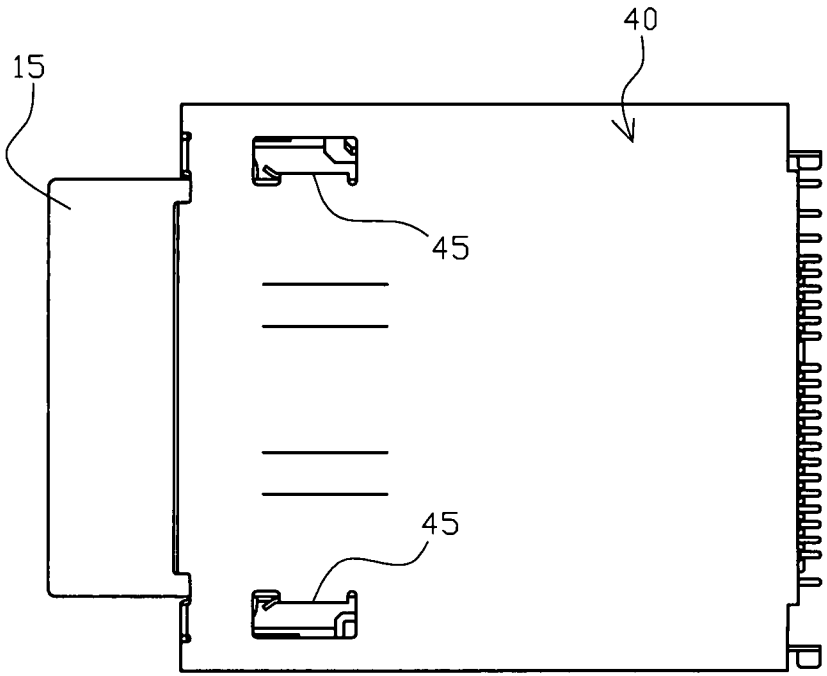
FIG. 12 is a top view showing a first a state when a small card is inserted according to the first embodiment of the invention.
Figure 13:
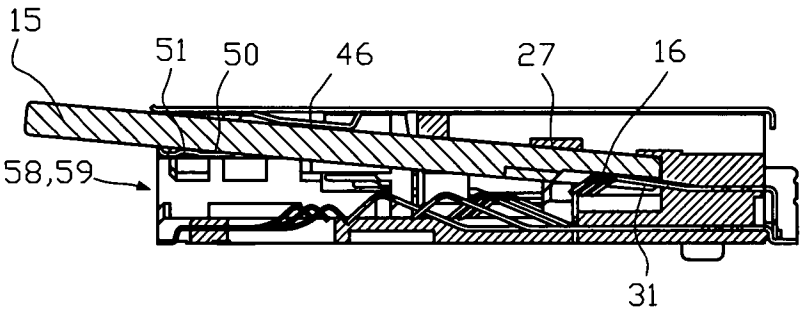
FIG. 13 is a laterally cross-sectional view showing the state when the small card is inserted according to the first embodiment of the invention.

As shown in FIGS. 12 and 13, the small card 15 may be inserted into the plastic base 20 slantingly downwards from the second inserting port 59 above the partition baffle 50. When the small card 15 is being inserted, two sides of the small card 15 can be positioned by the limited width of the second inserting port 59 and the small card 15 may be supported by the partition baffle 50. In addition, the small card 15 may be inserted into the plastic base 20 slantingly downwards by the first sloped surface 27, the second sloped surface 46 and the third sloped surface 51, and the inserted small card 15 is forwarded along the track formed by the gap between the two sided sheets 45. Thus, the connection points 16 of the small card 15 may be lowered and thus in direct contact with the first terminals 31.

As mentioned hereinabove, the small card 15 still can be inserted slantingly from the second inserting port 59 above the partition baffle 50 while the inserting and positioning of various cards and the big card 10 cannot be influenced. The partition baffle 50 can support the card to that the connection points can be electrically connected to the first terminals 31.

Figure 14:
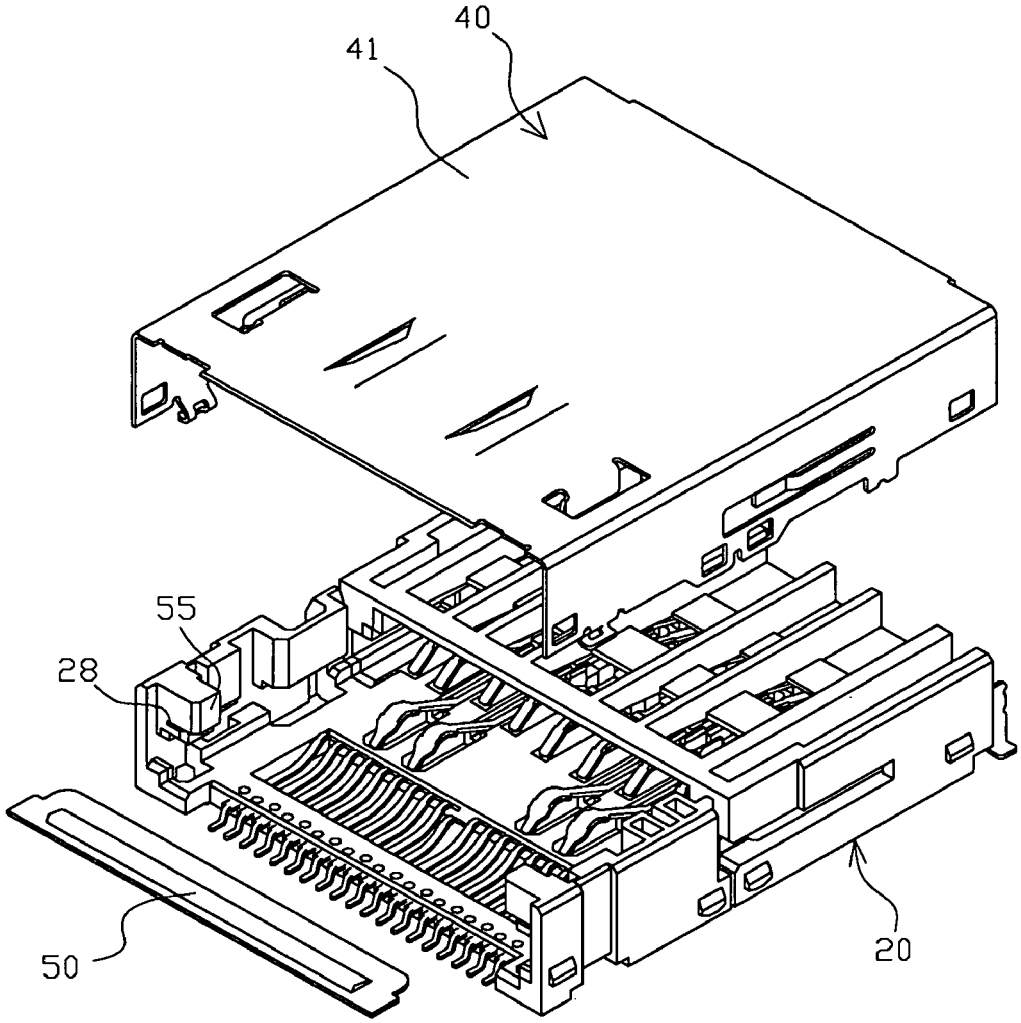
FIG. 14 is a pictorially exploded view showing an electrical card connector according to a second embodiment of the invention.
Figure 15:
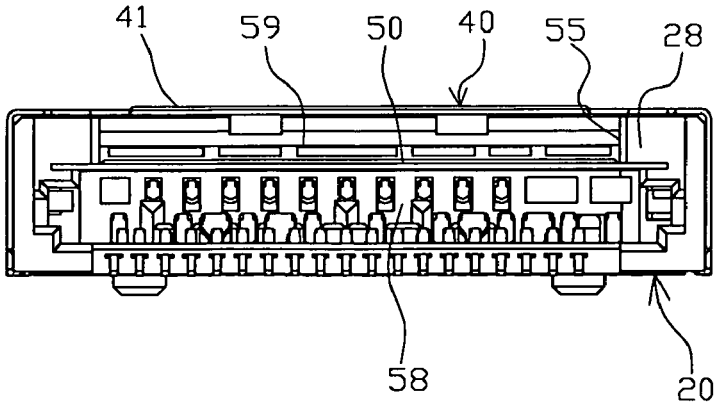
FIG. 15 is a front view showing the electrical card connector according to the second embodiment of the invention.

As shown in FIGS. 14 and 15, the second embodiment of the invention is almost the same as the first embodiment except that the partition baffle 50 is a metal sheet separated from the upper cover, the two side portion 55 and the plastic base are integrally formed, and a cavity 28 is formed on two sides of the front end of the plastic base 20 so that two sides of the partition baffle 50 are embedded into the cavities 28 for positioning.

Figure 16:
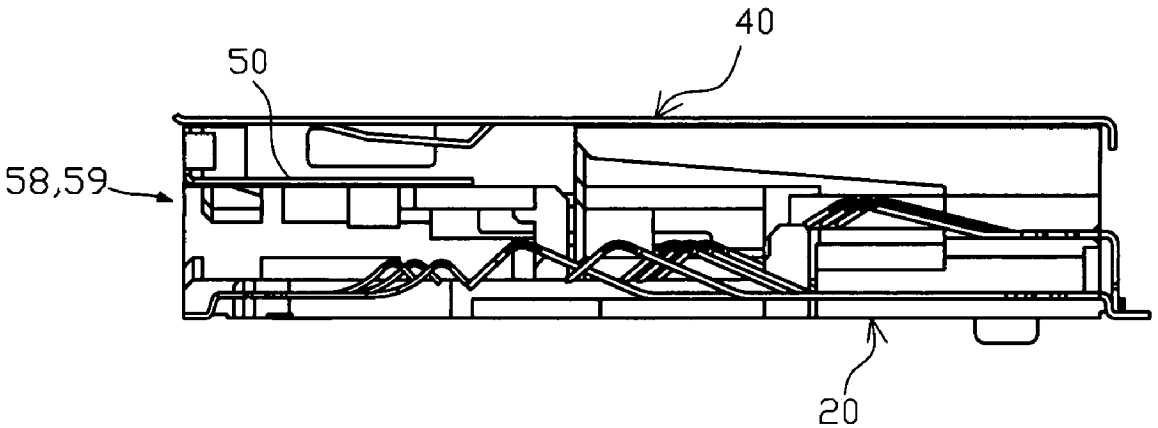
FIG. 16 is a laterally cross-sectional view showing an electrical card connector according to a third embodiment of the invention.
Figure 17:
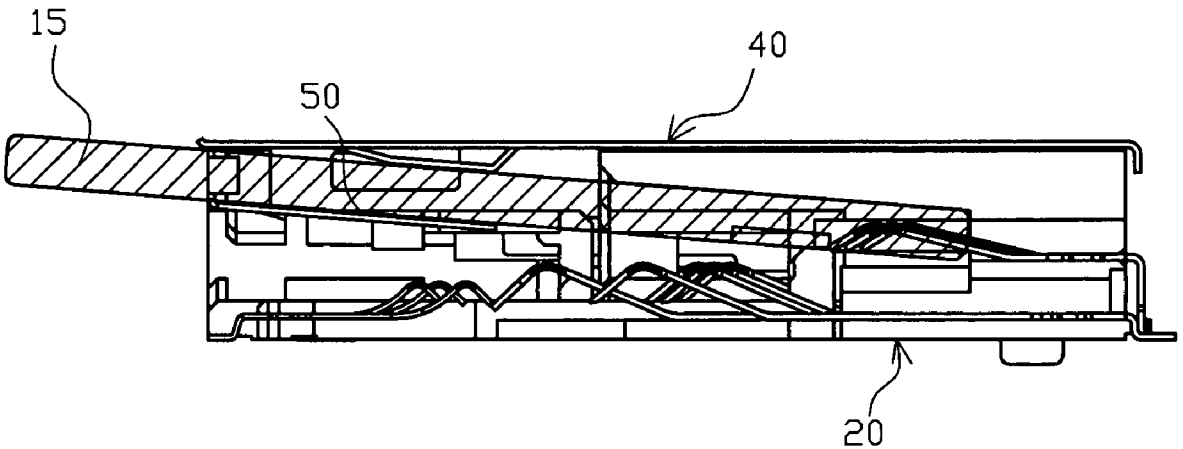
FIG. 17 is a laterally cross-sectional view showing a state when a small card is inserted according to the third embodiment of the invention.

As shown in FIGS. 16 and 17, the third embodiment of the invention is almost the same as the first embodiment except that the partition baffle 50 has the elasticity and can be moved elastically and moved up and down. The partition baffle 50 is horizontal and is elastically pressed down by the small card 15 when the small card 15 is inserted slantingly downwards from the second inserting port 59.

Figure 18:
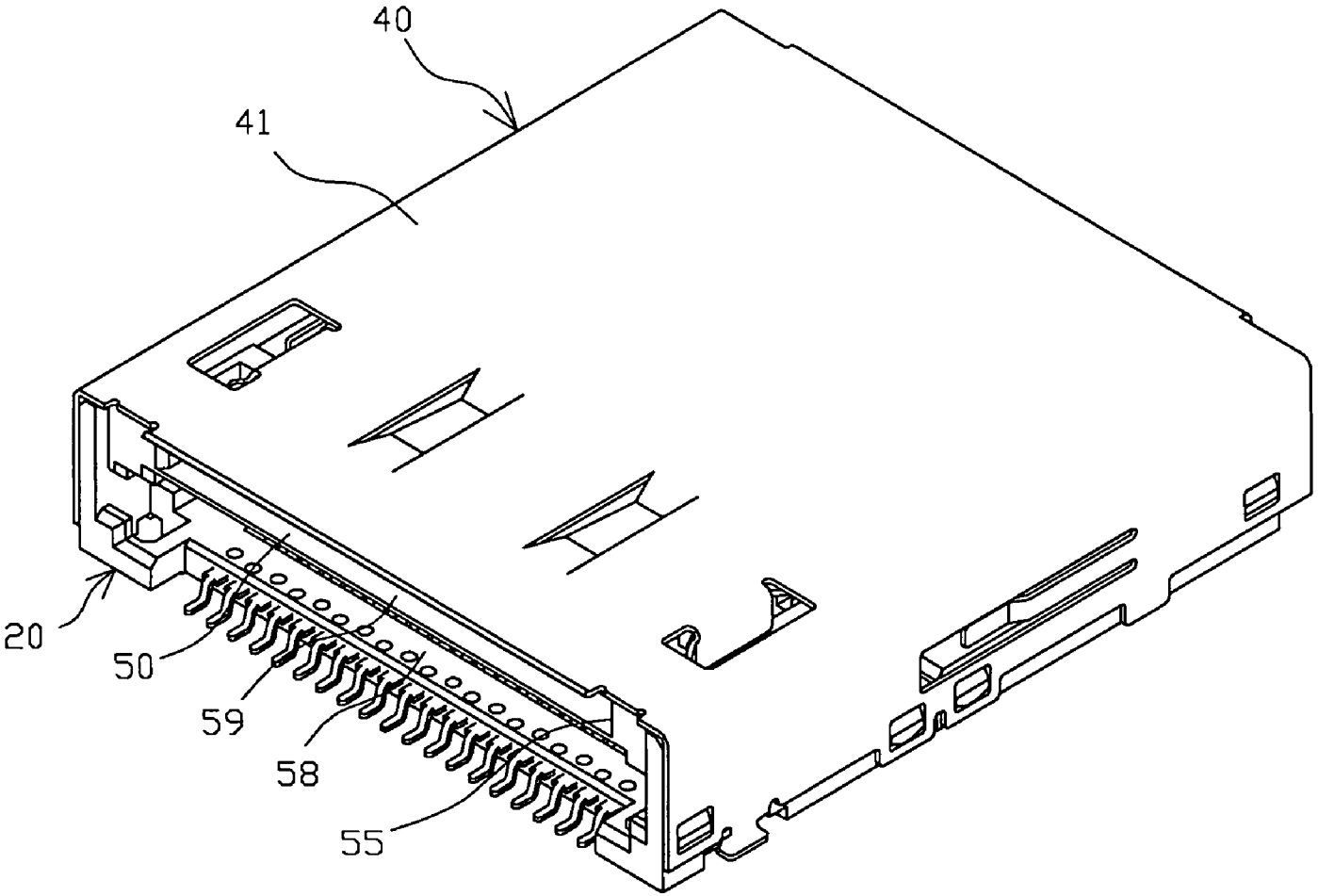
FIG. 18 is a pictorial view showing an electrical card connector according to a fourth embodiment of the invention.

As shown in FIG.18, the forth embodiment is almost the same as the first embodiment except that the partition baffle 50, the side portions 55 and the plastic base 20 are integrally formed.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. An electrical card connector to be connected to a first electrical card and a second electrical card, which is thinner and narrower than the first electrical card, first ends of the first and second electrical cards being formed with connection points arranged in the same manner, the electrical card connector comprising:

a plastic base having one row of first terminals and a first slot; and an upper cover, which has a top surface and covers over the plastic base, wherein:

a transversal partition baffle is disposed below a front end of the top surface of the upper cover;

each of two sides of the partition baffle is formed with a longitudinal side portion;

a first inserting port is formed below the partition baffle;

a second inserting port is defined and enclosed by the partition baffle, the two side portions and the top surface of the upper cover;

when the first electrical card is inserted into the first slot from the first inserting port, the connection points of the first electrical card are in direct contact with the first terminals; and when the second electrical card is slantingly inserted from the second inserting port, the connection points of the second electrical card are lowered and thus in direct contact with the first terminals.

2. The electrical card connector according to claim 1, wherein the plastic base further has a second slot and a third slot, and the first, second and third slots have different widths or heights and share a common space so that different electrical cards with different sizes may be respectively inserted and positioned.

3. The electrical card connector according to claim 1, wherein the second inserting port is narrower than the first slot.

4. The electrical card connector according to claim 1, wherein the partition baffle, the side portion and the plastic base are integrally formed.

5. The electrical card connector according to claim 1, wherein two sides of a front end of the plastic base are formed with cavities, and two sides of the partition baffle are embedded into the cavities and positioned in the cavities.

6. The electrical card connector according to claim 1, wherein the upper cover is made of a metal material.

7. The electrical card connector according to claim 6, wherein the partition baffle, the two side portions and the upper cover are integrally pressed and formed, and the partition baffle and the two side portions are bent downward from the front end of the top surface of the upper cover.

8. The electrical card connector according to claim 7, wherein the partition baffle can be moved up and down and be moved elastically.

9. The electrical card connector according to claim 6, wherein the upper cover is pressed inwards to form two side sheets, and positions of the two side sheets correspond to a width of the second inserting port so that the two side sheets form a track for insertion of the second electrical card.

10. The electrical card connector according to claim 1, wherein the plastic base has a first sloped surface, along which the second electrical card is inserted.

11. The electrical card connector according to claim 10, wherein the upper cover is pressed inwards to form a projecting second sloped surface, and the first sloped surface and the second sloped surface have the same slope.

12. The electrical card connector according to claim 10, wherein the partition baffle is formed with an upward projecting third sloped surface, and the third sloped surface and the first sloped surface have the same slope.

* * * * *